US011674346B2

(12) United States Patent
Sawyer

(10) Patent No.: US 11,674,346 B2
(45) Date of Patent: Jun. 13, 2023

(54) AMBIDEXTROUS HOLD OPEN HINGE

(71) Applicant: Schweitzer Engineering Laboratories, Inc., Pullman, WA (US)

(72) Inventor: Eric M. Sawyer, Moscow, ID (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 204 days.

(21) Appl. No.: 17/318,459

(22) Filed: May 12, 2021

(65) Prior Publication Data

US 2022/0364401 A1 Nov. 17, 2022

(51) Int. Cl.
*E05D 11/10* (2006.01)
*E05D 3/02* (2006.01)

(52) U.S. Cl.
CPC ..... *E05D 11/1007* (2013.01); *E05D 3/02* (2013.01); *E05D 11/1014* (2013.01); *E05D 2003/027* (2013.01); *E05Y 2201/22* (2013.01); *E05Y 2900/606* (2013.01)

(58) Field of Classification Search
CPC ... E05D 11/1007; E05D 3/02; E05D 11/1014; E05D 2003/027; E05D 11/06; E05Y 2201/22; E05Y 2900/606; E05Y 2900/132; Y10T 16/551
See application file for complete search history.

(56) References Cited

U.S. PATENT DOCUMENTS 769,035 A * 8/1904 Walter
975,097 A * 11/1910 Wright
1,440,713 A * 1/1923 Ausbourne ..... E05D 11/1078 16/324
1,489,679 A * 4/1924 Thornton ..... E05D 11/1007 16/349
1,707,628 A * 4/1929 Donosa ..... E05D 11/1007 16/330
2,488,688 A * 11/1949 William ..... E05D 11/1007 108/45
2,803,850 A * 8/1957 Georgem ..... E05D 11/06 16/374
3,822,440 A * 7/1974 Stansbury, Jr. ..... E05D 11/1014 16/303
3,874,029 A * 4/1975 McCullough ..... E05D 11/1007 16/329
3,921,422 A * 11/1975 Walters ..... E05D 11/1007 70/97
4,242,773 A * 1/1981 Beigh ..... E05D 3/12 16/371

(Continued)

*Primary Examiner* — Victor D Batson
*Assistant Examiner* — Matthew J Sullivan
(74) *Attorney, Agent, or Firm* — Bradley W. Schield; Richard M. Edge

(57) ABSTRACT

The present disclosure relates to an ambidextrous hinge. The ambidextrous hinge includes a first knuckle with a first engagement feature, a second knuckle with a second engagement feature, and a third knuckle movably coupled between the first knuckle and the second knuckle. The third knuckle includes a third engagement feature that engages the first engagement feature to cause the ambidextrous hinge to lock in a first open position when used as a first swing hinge. The third knuckle includes a fourth engagement feature that engages the second engagement feature to cause the ambidextrous hinge to lock in a second open position when used as a second swing hinge.

20 Claims, 7 Drawing Sheets

(56) References Cited

U.S. PATENT DOCUMENTS 4,340,992 A * 7/1982 Lombardi ..... E05D 11/1007 16/349
4,564,974 A * 1/1986 McGrail ..... E05D 11/1007 16/349
4,891,862 A * 1/1990 Holan ..... E05F 1/1284 16/334
5,287,596 A * 2/1994 Chen ..... E05D 11/06 16/376
5,769,261 A * 6/1998 Gaffney ..... E05D 1/06 220/212.5
6,317,928 B1 * 11/2001 Guillemette ..... E05D 7/1016 16/380
6,353,967 B1 * 3/2002 Escobar ..... E05D 11/06 16/374
7,197,791 B1 * 4/2007 Smith ..... E05D 11/06 16/334
8,060,985 B2 * 11/2011 Lin ..... G06F 1/1616 16/374
8,156,613 B2 * 4/2012 Smith ..... E05D 11/06 16/376
8,307,513 B1 * 11/2012 Fitzgerald ..... E05D 11/06 16/386
8,739,366 B2 * 6/2014 Heninger ..... E05D 11/06 16/374
D710,181 S * 8/2014 Christensen ..... D8/323
D726,525 S * 4/2015 Kenerly ..... D8/328
9,068,382 B1 * 6/2015 Hall ..... E05D 5/12
D790,317 S * 6/2017 Christensen ..... D8/323
9,816,303 B2 * 11/2017 Lee ..... E05D 11/06
D837,027 S * 1/2019 Christensen ..... D8/323
10,167,660 B2 * 1/2019 Ficker ..... B65D 25/005
10,407,958 B1 * 9/2019 Tsou ..... E05D 3/02
10,900,266 B2 * 1/2021 Jeffries ..... E05D 7/081
11,447,993 B1 * 9/2022 Reger ..... E05D 11/0027
11,523,681 B2 * 12/2022 Chen ..... A47B 3/0809
2014/0173852 A1 * 6/2014 Heninger ..... E05D 7/105 16/375
2014/0259532 A1 * 9/2014 Millard ..... E05D 11/1028 16/326
2018/0030766 A1 * 2/2018 Yeom ..... E05D 3/02
2019/0112853 A1 * 4/2019 Mccafferty ..... E05D 11/06
2019/0186186 A1 * 6/2019 Tamer ..... E05D 11/06
2019/0249822 A1 * 8/2019 Katz ..... F16B 5/0088
2022/0364402 A1 * 11/2022 Cardwell ..... E05D 3/02

* cited by examiner

AMBIDEXTROUS HOLD OPEN HINGE

TECHNICAL FIELD

The present disclosure relates generally to enclosures and, more particularly, to an ambidextrous hinge that can be placed in a hold open position when used in either direction.

BRIEF DESCRIPTION OF THE DRAWINGS

Non-limiting and non-exhaustive embodiments of the disclosure are described herein, including various embodiments of the disclosure with reference to the figures listed below.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Electric power delivery systems are used to transmit and distribute electric power from electric power generation sources to loads, which may be close or distant from the generation sources. Such systems may include generators or other sources, transformers, transmission lines, buses, distribution lines, voltage regulators, capacitor banks, reactors, circuit breakers, switches, and other such equipment. Electric power delivery equipment may be monitored, automated and/or protected using intelligent electronic devices (IEDs). One or more IEDs or other equipment may be housed in an enclosure, which may have a cabinet or body that houses the electronics and/or ensures safety of the IEDs. The enclosure may have a door that can be opened by an operator to access the IEDs and any other equipment (e.g., wiring, connections, etc.).

While an operator is accessing the IED, a door stay may be used to secure the door in an open position through winds and/or rain. However, such door stays add significant cost to each enclosure and do not always operate as desired. Further, depending on the electronics and/or equipment used in the enclosure or operator preference, the enclosure may open to the left or open to the right.

As explained below, an ambidextrous hinge that is capable of engaging in a hold open position may be used to eliminate the need for a door stay. Further, due to the ambidextrous configuration, the hinge may be used with a right opening or a left opening door while still having a hold open position for each side.

Figure 1:
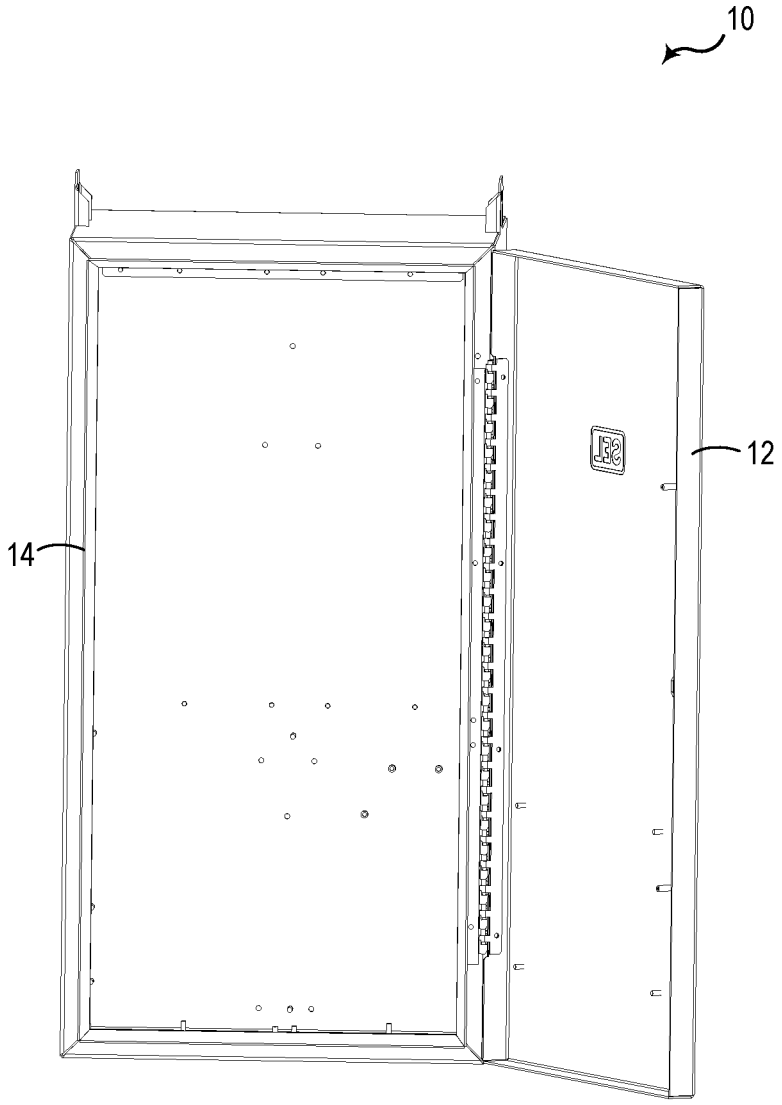
FIG. 1 illustrates a perspective view of an enclosure having a door rotatably coupled to a cabinet via an ambidextrous hinge, in accordance with an embodiment.

FIG. 1 is a perspective view of a power system enclosure 10 that is used to house IEDs and/or other electrical equipment on a power system. For example, the enclosure 10 may house a relay, such as a protective relay, recloser controller, distribution controller, power meter, DIN rails, electrical connections, displays, programmable logic controller (PLC), and the like. The enclosure 10 may be installed in a substation, on a power line structure, or any other suitable location.

The enclosure 10 includes a door 12 that is rotatably coupled to a body 14, also referred to as the cabinet, of the enclosure via a hinge 20. The hinge 20 allows the door 12 to rotate between a closed position in which the IED(s) and/or other electrical equipment are protected to an open position, as shown in FIG. 1, in which the operator has access to an interior of the body 14 of the enclosure 10. The operator may open the door 12 of the enclosure 10 to perform maintenance or service the IEDs and/or electrical equipment.

To perform maintenance, the operator may rotate the door 12, via the hinge 20, to an open position and secure the door in the open position such that the door does not close during the maintenance period. As mentioned above, one technique for securing the door 12 open is with a mechanical door stay that does not close without applying a certain amount of force. However, door stays can be costly and may not operate as desired.

Figure 2:
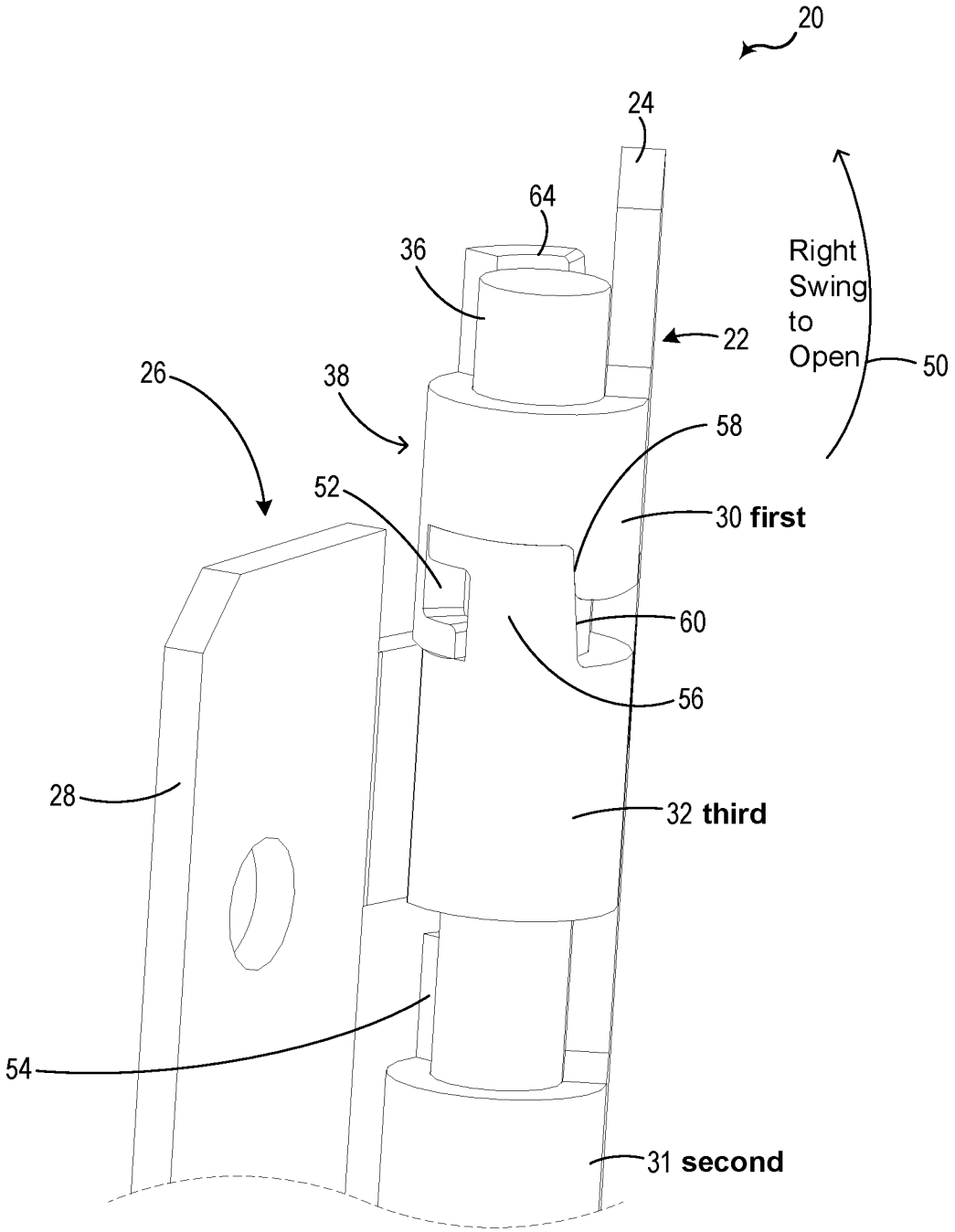
FIG. 2 illustrates a perspective view of the ambidextrous hinge used on a right swing open door with the ambidextrous hinge in a first locked open position, in accordance with an embodiment.

FIG. 2 is a perspective view of the hinge 20 installed on a right swing open door and locked in the open position without the use of a separate door stay. The hinge 20 may be a type of piano hinge with a first side 22 that that is coupled to the door via a first leaf 24 and a second side 26 that is coupled to the body of the enclosure via a second leaf 28.

The first side 22 includes a first set of knuckles coupled to the first leaf 24 and the second side 26 includes a corresponding second set of knuckles coupled to the second leaf 28 along the longitudinal axis of the hinge 20 that are curved cylindrically around the pin 36 to form a hinge barrel 38. The first set of knuckles of the first side and 22 and the knuckles of the second side alternate along the longitudinal body of the pin 36 between each other. For example, the first set of knuckles may include a first knuckle 30 and a second knuckle 31, and the second set of knuckles may include a third knuckle 32 between the first and second knuckles 32 along the pin 36. As mentioned above, the body 14 of the enclosure 10 may be in a fixed position within a substation or mounted to another structure. The pin 36 and the knuckles 30-32 allow the first leaf 24 and the door to rotate with respect to the fixed enclosure to allow the operator to access the interior of the body 14 or to secure the IEDs and/or other electrical equipment within the enclosure 10. The hinge 20 may be ambidextrous (i.e., bidirectional) such that the same hinge 20 may be installed either on a right swing door as illustrated or on a left swing door. Further, the first set of knuckles and the second set of knuckles may move longitudinally along the pin 36 with respect to each other by upwards forces from lifting the door or downwards forces due to gravity. The longitudinal movement of the first set of knuckles with respect to the second set of knuckles may be used to lock the door in a hold open position via engaging sets of engagement features.

In the illustrated embodiment, the door is installed for a right swing (arrow 50) enclosure in a secured open position. The first knuckle 30 includes a first engagement feature, such as a notch 52 (i.e., opening), and the second knuckle 31 includes a second engagement feature, such as a tab 54. The third knuckle 32 includes a third engagement feature, such as a boss 56, that engages the first engagement feature to secure the door in the open position when the hinge is used as a right swing open hinge. The hinge is secured in the open position using a first set of engagement features (e.g., the first engagement feature and the second engagement feature) when used as a right swing open hinge due to gravitational forces on the door side hinge 22 causing the weight of the door to maintain engagement of the first set of engagement features.

As explained below, the third knuckle may include a fourth engagement feature, such as a notch (i.e., opening) that engages the second engagement feature, such as a tab 54 of the second knuckle 31 to secure the door in the open position when the hinge is used as a left swing open hinge. That is, when the illustrated hinge 20 is rotated 180 degrees and used to rotatably couple a left swing door to an enclosure, the fourth engagement feature may engage a second engagement feature to allow the door to be secured in the open position. For example, the fourth engagement feature on the opposite longitudinal side of the knuckle 32 may engage the second engagement feature (e.g., tab 54) on the opposite neighboring knuckle 31 and be secured in a second engaged position due to gravitational forces being opposite when the door is installed as a left swing door. Further, the second and fourth engagement features may be on the opposite axial side as the first and third engagement feature of the knuckles due to the open position of a left swing door being opposite the open position from a right swing door. By having a hinge that can be secured in the open position ambidextrously, the same hinge may be used on both left swing and right swing doors while also locking the door in a first open position by engaging the first set of engagement features (e.g., first engagement feature and third engagement feature) when used as a right swing door and locking the door in a second open position by engaging the second set of engagement features (e.g., second engagement feature and fourth engagement feature) when used as a left swing door.

In some embodiments, a ramp angle 58 of the notch 52 and a corresponding ramp 60 of the boss 56 may be selected based on the expected forces applied to the hinge. For example, a more inclined angle of greater than 40 degrees (e.g., greater than 50 degrees, 60 degrees, 70 degrees, 80 degrees, etc.) may ensure that the door is secured in the open position through winds in a given location. In the illustrated embodiment, a contour of the boss 56 may correspond to the contour of the notch 52 such that the boss 56 and notch 52 prevent movement (e.g., opening or closing) of the door without lifting of the door.

Figure 3:
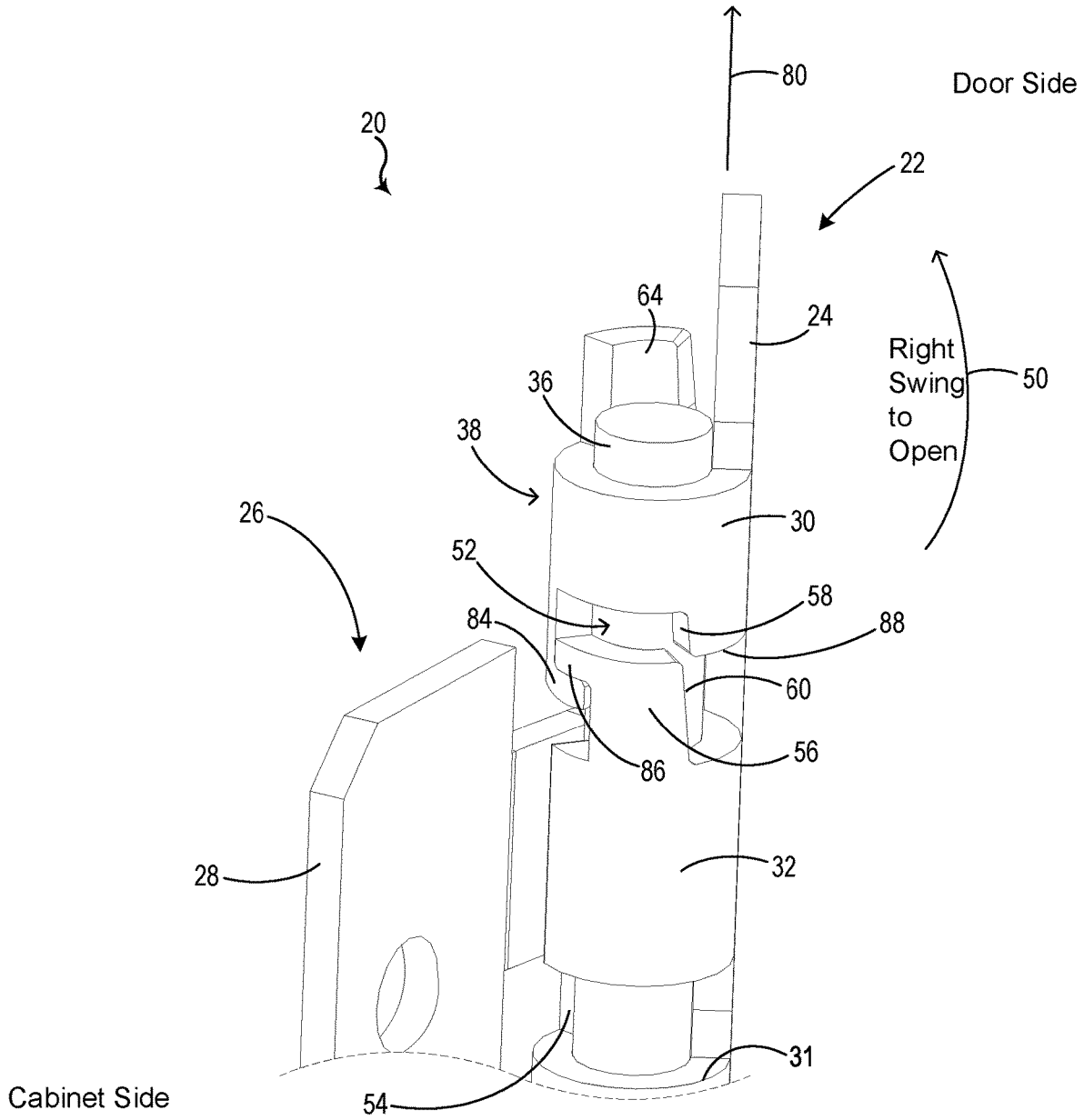
FIG. 3 illustrates perspective view of the ambidextrous hinge used on a right swing open door with the door side of the hinge in a raised position to disengage the locked open position of FIG. 2, in accordance with an embodiment.

FIG. 3 is a perspective view of the hinge 20 having the door in a lifted position from an operator moving the door in a raised direction 80 such that the first knuckle 30 is in an elevated position with respect to the third knuckle 32. In the illustrated embodiment, a catch 86 of the boss 56 is blocked by a corresponding protrusion 84 of the notch 52 to prevent the opposite direction tab 54 from engaging the corresponding notch due to the door being lifted vertically when disengaging the door from the door open position. By preventing direct vertical engagement of the opposite side due to an operator lifting the door, an operator may exert a variety of upward forces to disengage the boss 56 and the notch 52 without causing the opposite side to engage.

When the door is rotated towards the closed position, the operator may continue to apply an upward force, relax the upward force applied, or apply a force anywhere therebetween. If the operator relaxes the upward force applied, the weight of the door may cause a bottom 88 of the door side knuckle 30 to rest and slide on top of the cabinet boss 56 as the door rotates shut. As illustrated, the catch 86 may be fitted such that when the catch breaks contact with the protrusion 84 on a first end of the boss 56, a second end of the boss 56 (e.g., ramp 60) may extend beyond an end of the notch 52 to prevent the door from moving back into the locked position. If the operator continues to apply the upward force, then a door side tab and transition ramp may direct the door back into alignment.

Figure 4:
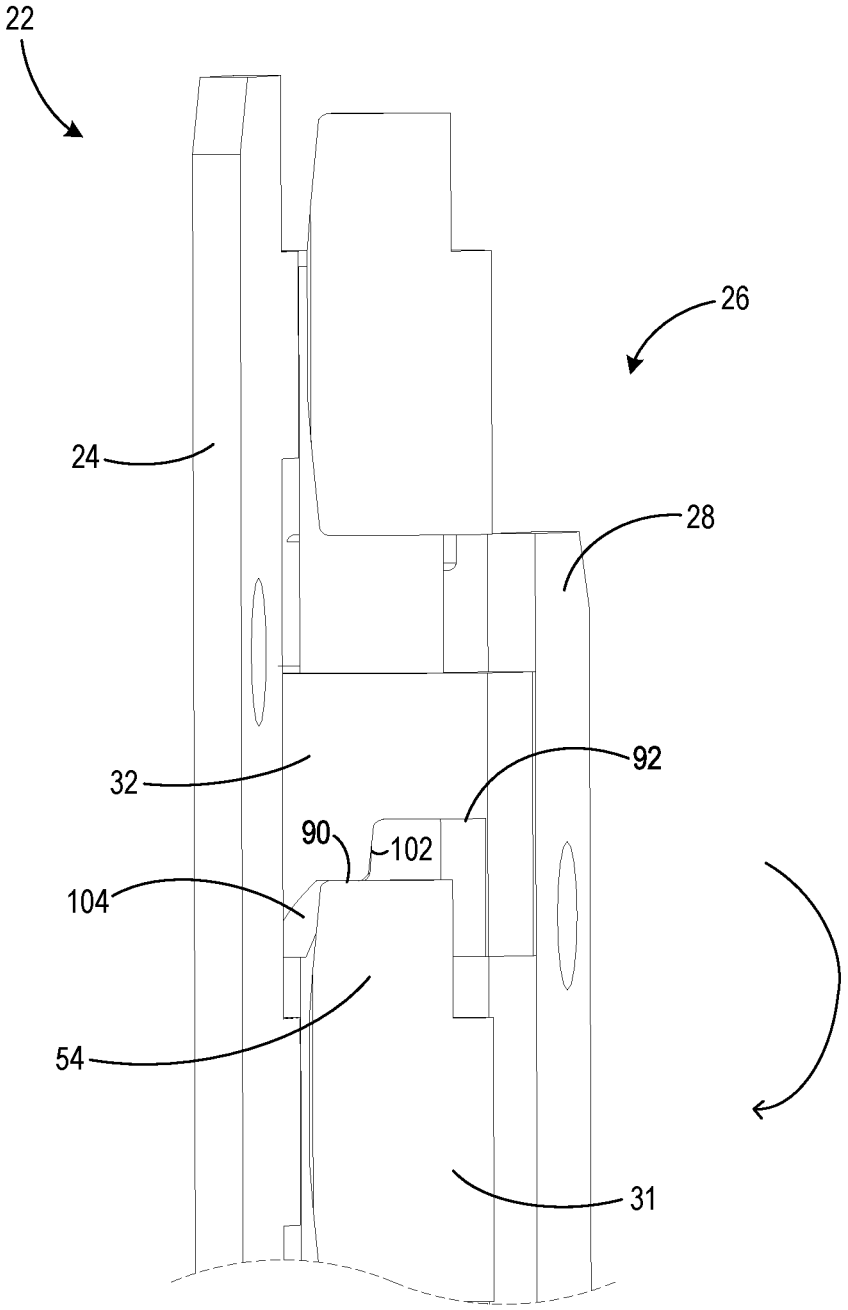
FIG. 4 illustrates perspective view of the ambidextrous hinge used on a right swing open door while the door is being closed following the raised position of FIG. 3, in accordance with an embodiment.

FIG. 4 is a perspective view of the hinge 20 when the catch 86 breaks contact with the protrusion 84 and an operator continues to apply an upward force to the door while the operator closes the door. Following the lifted position of FIG. 3, the operator may begin rotating the door to the closed position. As the door is rotated and the catch 86 disengages with the protrusion 84, if the operator continues exerting an upward force, the tab 54 rotates beyond an end 102 of a notch 92 such that the transition flat 90 prevents the tab 54 of the door side hinge from engaging the corresponding notch 92 that is used to lock open the door when used as a left swing hinge. The knuckle 32 includes a transition ramp 104 that moves the door into alignment with the cabinet when closing the door and upward force is continued. As mentioned above, the same hinge may be ambidextrous such that the right swing hinge described in FIGS. 1-4 may be flipped 180 degrees and used as a left swing hinge as in FIGS. 5-7.

Figure 5:
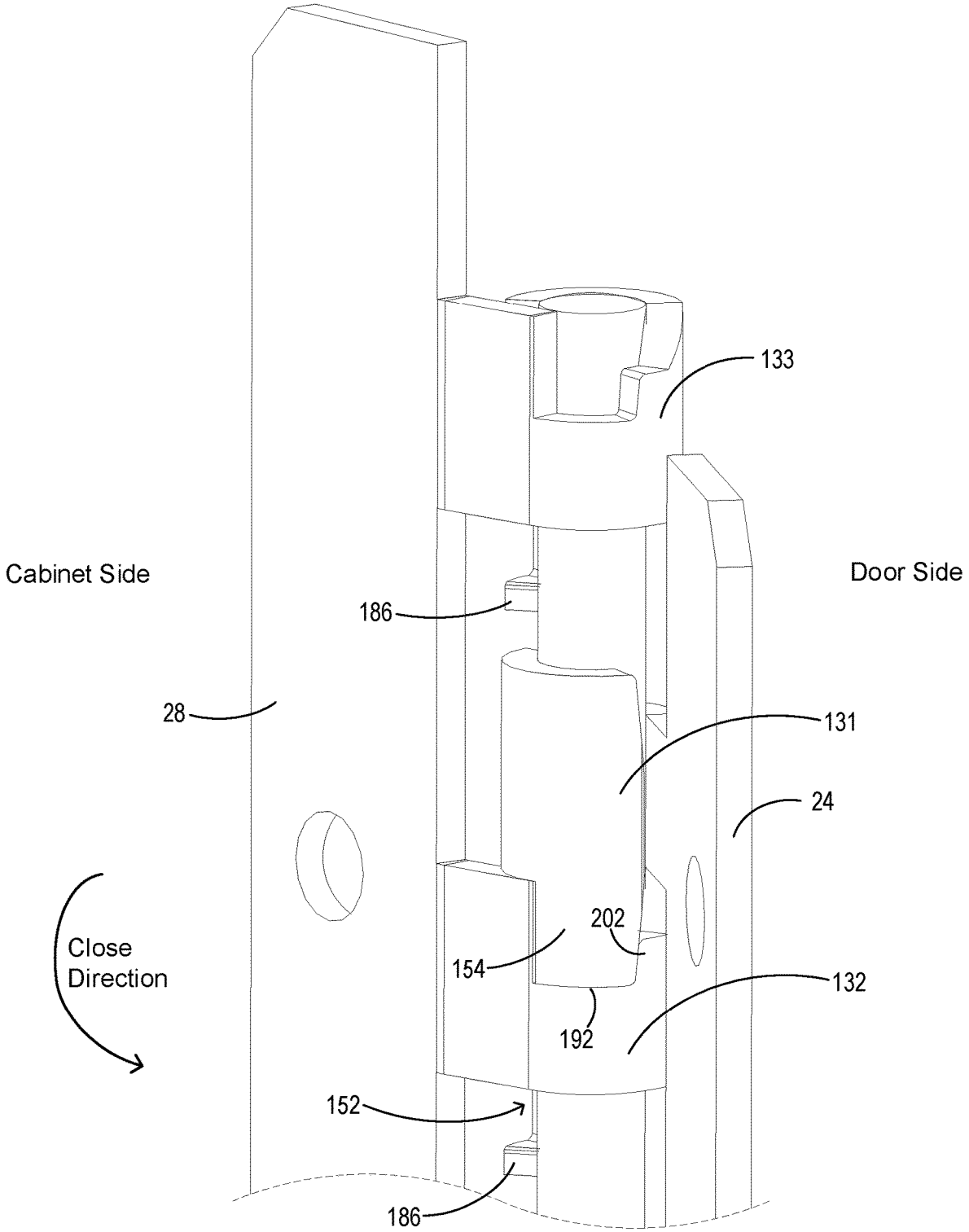
FIG. 5 illustrates perspective view of the ambidextrous hinge of FIG. 1 used on a left swing open door with the door in a second locked open position, in accordance with an embodiment.

FIG. 5 is a perspective view of the ambidextrous hinge being used as a left swing hinge in a locked open position. As illustrated, the hinge is flipped 180 degrees. The cabinet side knuckles 32, 132, and 133 may each be the same or similar to each other. For example, the knuckle 132 may have a notch 192 the same or similar to the notch 92 of knuckle 32 and have a boss (shown as 156 in FIG. 6) on the opposite end similar to the boss 56. Further, the knuckles 30, 31, and 131 may be the same or similar to each other, for example, having a tab 154 similar to the tabs 54 and 64 and a notch 152 similar to the notch 52. As such, the knuckle 131 may be referred to as the second knuckle 31 and the knuckle 132 may be referred to as the third knuckle as the same or similar knuckles are positioned on the opposite end of the hinge 20 with the same or similar features.

As illustrated, the third knuckle moves longitudinally to engage the neighboring knuckle (i.e., the second knuckle) when used as a left swing hinge opposite the other neighboring knuckle (i.e., the first knuckle) when used as a right swing hinge. Further, the weight of the door side hinge 24 causes the second engagement feature (e.g., tab 154) of the second knuckle 131 to engage a fourth engagement feature (e.g., notch 192) of the third knuckle 132. The weight of the door prevents the tab 154 from disengaging from the notch 192 due to winds or other forces, thereby securing the door in a left swing open position. To close the door, an operator may apply an upward force to lift the tab 154 from the notch 192 to cause disengagement of the second and fourth engagement features.

Figure 6:
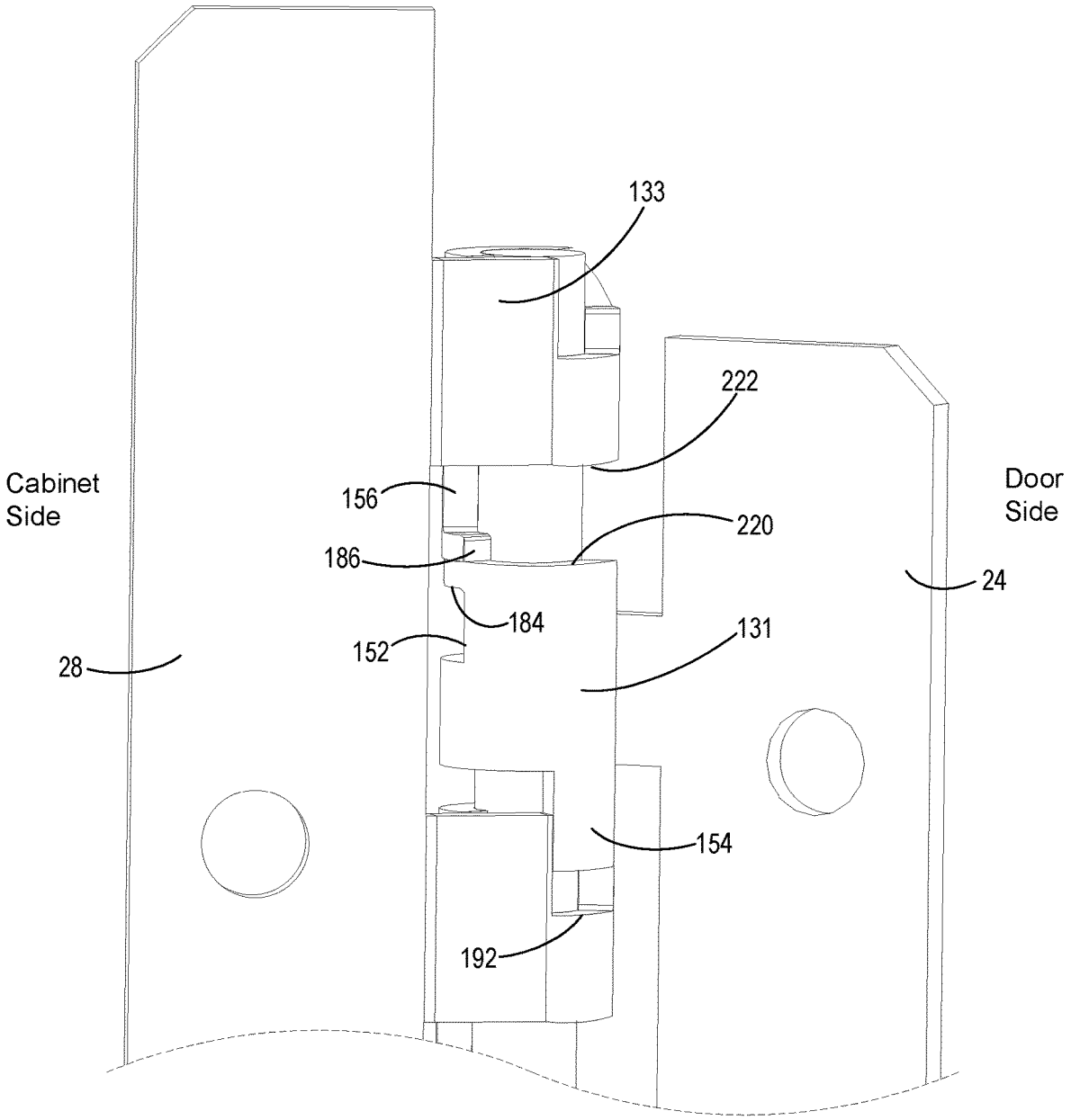
FIG. 6 illustrates perspective view of the ambidextrous hinge used on a left swing open door with the door in a raised position to disengage the locked open position of FIG. 5, in accordance with an embodiment.

FIG. 6 is a perspective view of the ambidextrous hinge being used as a left swing hinge in a raised position in which the tab 154 is disengaged from the notch 192. As illustrated, the catch 186 and the protrusion 184 block the boss 156 from engaging the notch 152 to prevent the hinge from engaging in the opposite locked position that is used when the hinge is used as a right swing hinge. An operator may continue to apply an upward force following disengagement of the tab 154 and the notch 192, relax the upward force following disengagement of the tab 154 and the notch 192, or any force therebetween. If the operator continues the upward force, once the catch 186 breaks contact, the top 220 of the knuckle 131 will contact and slide along the bottom 222 of the cabinet side knuckle 133 as the door rotates shut.

Figure 7:
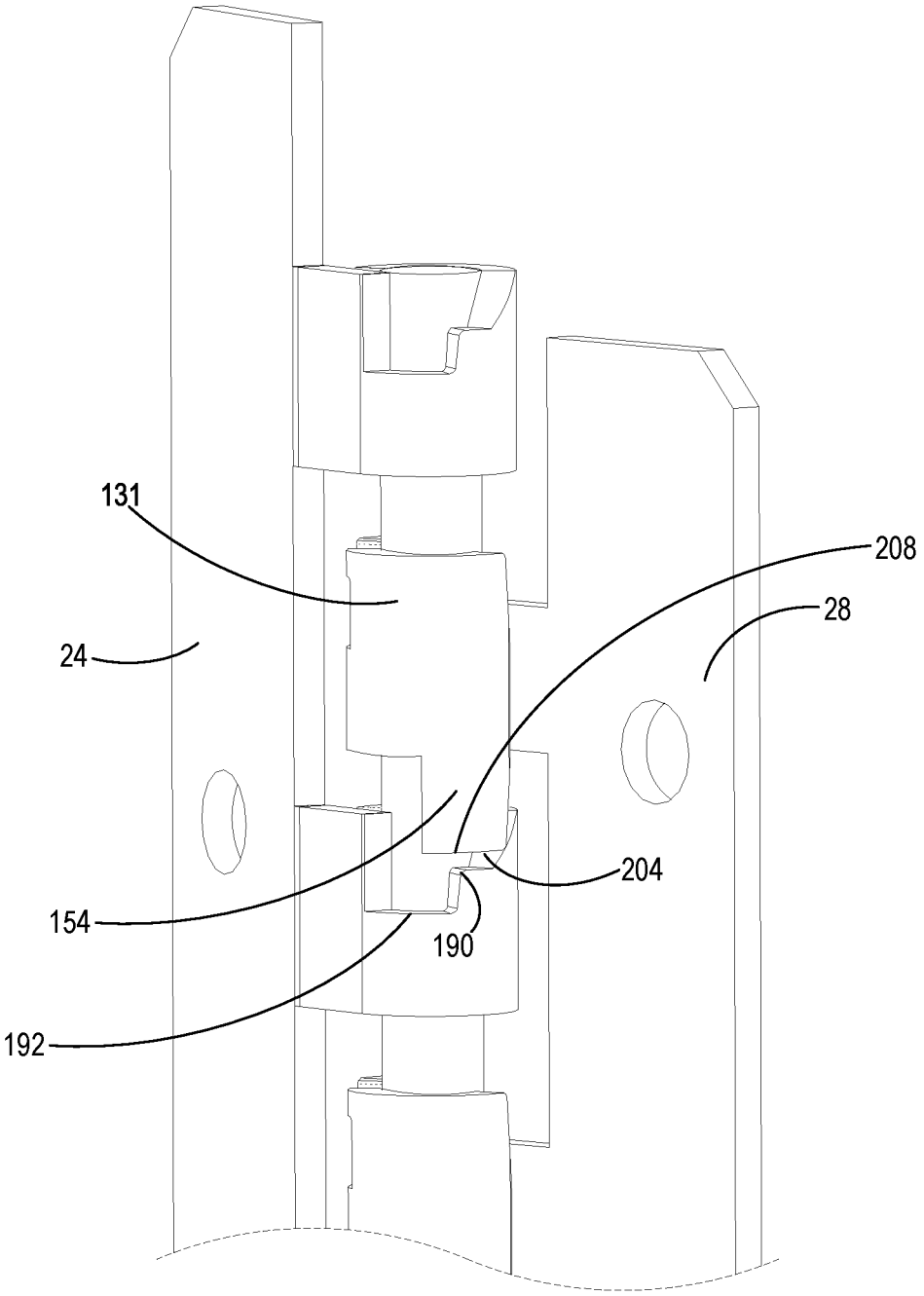
FIG. 7 illustrates perspective view of the ambidextrous hinge used on a left swing open door while the door is being closed following the raised position of FIG. 6, in accordance with an embodiment.

FIG. 7 is a perspective view of the ambidextrous hinge being used as a left swing hinge being closed following the raised position in FIG. 6 where the operator relaxes the upward force. As illustrated, when the operator relaxes the upward force, the bottom 208 of the door side tab 154 will slide across the transition flat 190 up the transition ramp 204 moving the door into proper alignment at closure of the door. While the embodiments described above include bosses, tabs, and notches, this is simply meant to be illustrative and any suitable combination of engagement features may be used.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An ambidextrous hinge, comprising:

a first leaf;

a second leaf;

a first knuckle coupled to the first leaf, wherein the first knuckle comprises a first engagement feature;

a second knuckle couple to the first leaf, wherein the second knuckle comprises a second engagement feature; and a third knuckle coupled to the second leaf and movably coupled between the first knuckle and the second knuckle, wherein the third knuckle comprises a third engagement feature configured to engage the first engagement feature to cause the ambidextrous hinge to lock in a first open position when the ambidextrous hinge is installed for a first swing direction, wherein the third knuckle comprises a fourth engagement feature configured to engage the second engagement feature to cause the ambidextrous hinge to lock in a second open position when the ambidextrous hinge is installed for a second swing direction.

2. The ambidextrous hinge of claim 1, wherein the third knuckle comprises the third engagement feature on a first longitudinal end of the third knuckle the third knuckle comprises the fourth engagement feature on a second longitudinal end of the third knuckle, opposite the first longitudinal end.

3. The ambidextrous hinge of claim 1, wherein the third knuckle comprises a boss as the third engagement feature and the first knuckle comprises a notch as the first engagement feature, wherein the boss is configured to engage the notch to lock the door in the first open position when the ambidextrous hinge is installed for the first swing direction.

4. The ambidextrous hinge of claim 3, wherein the boss comprises a catch and the notch comprises a protrusion, wherein a first side of the protrusion is configured to contact a first side of the catch when the third engagement feature disengages from the first engagement feature to prevent the fourth engagement feature from engaging the second engagement feature.

5. The ambidextrous hinge of claim 4, wherein, when used a second swinge hinge, contact between a second side of the catch with a second side of the protrusion prevents the third engagement feature from engaging the first engagement feature while the second engagement feature disengages from the fourth engagement feature.

6. The ambidextrous hinge of claim 1, wherein the first leaf is coupled to a cabinet of a power system enclosure and the second leaf is coupled to a door.

7. The ambidextrous hinge of claim 1, wherein the third knuckle comprises a tab as the fourth engagement feature and the second knuckle comprises a notch as the second engagement feature, wherein the tab is configured to engage the notch to cause the ambidextrous hinge to lock in the second open position when the ambidextrous hinge is installed for the second swing direction.

8. The ambidextrous hinge of claim 7, wherein the notch comprises a transition flat configured to prevent the notch from re-engaging when a door is being closed.

9. The ambidextrous hinge of claim 8, wherein the notch comprises a transition ramp configured to guide the door during closing to transition the door into alignment with a cabinet of a power system enclosure.

10. The ambidextrous hinge of claim 1, wherein the ambidextrous hinge is used as a right swing hinge when installed for the first swing direction and used as a left swing hinge when installed for the second swing direction.

11. The ambidextrous hinge of claim 1, wherein the third engagement feature is different from the fourth engagement feature to prevent unintentional engagement.

12. An ambidextrous hinge, comprising:

a first plurality of knuckles comprising a first knuckle and a second knuckle, wherein each knuckle of the first plurality comprises a first engagement feature on a first end and a second engagement feature on a second end;

a second plurality of knuckles, wherein each knuckle of the second plurality comprises a third engagement feature on a first end and a fourth engagement feature on a second end; and wherein a third knuckle of the second plurality is movably coupled between the first knuckle and the second knuckle, wherein the third engagement feature of the third knuckle is configured to engage the first engagement feature of the first knuckle to cause the ambidextrous hinge to lock in a first open position and the fourth engagement feature of the third knuckle is configured to engage the second engagement feature of the second knuckle to cause the ambidextrous hinge to lock in a second open position.

13. The ambidextrous hinge of claim 12, wherein the first plurality of knuckles and the second plurality of knuckles are curved around a pin such that the second plurality of knuckles are configured to move in a longitudinal direction with respect to the first plurality of knuckles to control engagement of the first, second, third, and fourth engagement features.

14. The ambidextrous hinge of claim 12, wherein the third engagement feature is different from the fourth engagement feature to prevent unintentional engagement.

15. The ambidextrous hinge of claim 12, wherein the third knuckle comprises a notch as the third engagement feature and the first knuckle comprises a boss as the first engagement feature, wherein the boss is configured to engage the notch to lock the door in first open position when the ambidextrous hinge is installed for a first swing direction.

16. The ambidextrous hinge of claim 12, wherein the third knuckle comprises a tab as the fourth engagement feature and the second knuckle comprises a notch as the second engagement feature, wherein the tab is configured to engage the notch to cause the ambidextrous hinge to lock in the second open position when the ambidextrous hinge is installed for a second swing direction.

17. An ambidextrous hinge, comprising:

a first knuckle comprising a first engagement feature;

a second knuckle comprising a second engagement feature; and a third knuckle movably coupled between the first knuckle and the second knuckle, wherein the third knuckle comprises a third engagement feature on a first end of the third knuckle and a fourth engagement feature on a second end of the third knuckle, wherein the third engagement feature is configured to engage the first engagement feature to cause the ambidextrous hinge to lock in a first open position when the ambidextrous hinge is installed for a first swing direction and to engage the second engagement feature to cause the ambidextrous hinge to lock in a second open position when the ambidextrous hinge is installed for a second swing direction.

18. The ambidextrous hinge of claim 17, wherein the first knuckle, the second knuckle, and the third knuckle comprise an opening to receive a pin, wherein the third knuckle is configured to move longitudinally along the pin between the first knuckle and the second knuckle to selectively engage the first engagement feature with the third engagement feature and the second engagement feature with the fourth engagement feature.

19. The ambidextrous hinge of claim 17, comprising a first leaf coupled to the first knuckle and the second knuckle and a second leaf coupled to the third knuckle.

20. The ambidextrous hinge of claim 17, wherein the ambidextrous hinge is configured to be coupled to either a left swing door or a right swing door.

* * * * *